US005170422A

United States Patent [19]

Fiebiger

[11] Patent Number: 5,170,422

[45] Date of Patent: Dec. 8, 1992

[54] ELECTRON EMITTER FOR AN X-RAY TUBE

[75] Inventor: Clemens Fiebiger, Erlangen, Fed. Rep. of Germany

[73] Assignee: Siemens Aktiengesellschaft, Munich, Fed. Rep. of Germany

[21] Appl. No.: 738,877

[22] Filed: Aug. 1, 1991

[30] Foreign Application Priority Data

Aug. 20, 1990 [DE] Fed. Rep. of Germany ..... 4026301

[51] Int. Cl.[5] ..... H01J 35/06

[52] U.S. Cl. ..... 378/136; 378/138; 313/346 R

[58] Field of Search ..... 378/136, 138, 121, 119; 313/326, 340, 341, 345, 346 R

[56] References Cited

U.S. PATENT DOCUMENTS

| | | | |
|---|---|---|---|
| 3,303,372 | 2/1967 | Gager . | |
| 3,700,951 | 10/1972 | Clarke et al. | 313/346 R |
| 3,833,494 | 9/1974 | Van Stratum et al. . | |
| 3,970,888 | 7/1976 | Tratiner . | |
| 4,012,656 | 3/1977 | Norman et al. . | |
| 4,150,318 | 4/1979 | Kerstetter . | |
| 4,151,440 | 4/1979 | Buescher . | |
| 4,250,429 | 2/1981 | Lersmacher et al. . | |
| 4,291,252 | 9/1981 | Aida et al. . | |
| 4,661,740 | 4/1987 | Knoch et al. | 313/346 R |
| 4,730,353 | 3/1988 | Ono et al. . | |
| 4,752,713 | 6/1988 | Buxbaum . | |

FOREIGN PATENT DOCUMENTS

| | | |
|---|---|---|
| 836527 | 4/1952 | Fed. Rep. of Germany . |
| 2727907 | 1/1979 | Fed. Rep. of Germany . |
| 949312 | 2/1964 | United Kingdom . |
| 1188668 | 4/1970 | United Kingdom . |

*Primary Examiner*—David P. Porta

[57] ABSTRACT

An electron emitter for an x-ray tube is formed by a geometrical member that is completely filled with electron-emitting material. This emitter can be excited to emit electrons over its entire side facing toward the anode. The electron-emitting material is composed of a mixture of conductive metal powder and a non-conductive powder or a ceramic material. A uniform distribution of the electrons in the focal spot of the anode is obtained in substantially all expected operating conditions of an x-ray tube, so that the x-radiation generated in the focal spot is correspondingly uniform. Further, the electron emitter can be manufactured in a simple manner.

9 Claims, 1 Drawing Sheet

ELECTRON EMITTER FOR AN X-RAY TUBE

BACKGROUND OF THE INVENTION

1. Field of the Invention

The present invention is directed to an electron emitter, and in particular to an electron emitter suitable for use as an electron source in an x-ray tube.

2. Description of the Prior Art

For generating x-radiation, conventional x-ray tubes have a cathode and an anode fused in a glass member opposite one another. The cathode has a helical or serpentine tungsten wire. This tungsten wire can be heated to emission temperature by applying a voltage, so that it is surrounded by an electron cloud. For generating x-radiation, a voltage can be applied to the cathode and to the anode, whereby the electrons are accelerated onto the anode where they convert their energy into heat and x-radiation. The surface of the anode onto which the electrons are incident is referred to below as the focal spot. Increasing the cathode-to-anode voltage results in all emitted electrons being ultimately accelerated onto the anode; the x-ray tube is thus driven into the saturation range. In this operating condition, the electrons are directly extracted from the tungsten wire that is thus projected onto the focal spot as the electron occupation. Since the tungsten wire is fashioned as a helix or in serpentine form, this leads to a varying electron occupation in the focal spot, as a result of which the x-radiation generated in the focal spot is likewise non-uniform. Upon transillumination of an exposure subject, this non-uniform distribution of the x-radiation is superimposed on the radiation shadow image of the exposure subject, which is undesirable.

German AS 11 49 115 discloses a cathode for an x-ray tube for generating a uniform electron occupation on the anode. To this end, this cathode is formed by an elongated, uncoiled glow wire that is convexly-arcuately shaped opposite the propagation direction of the electrons. A metallic shielding having a slot that accepts the glow wire is provided, with the front faces of the shielding which project beyond the glow wire in the direction of the anode being also convexly-arcuately shaped. Given this arrangement, high demands must be made on the electron-optical system in order to focus the emitted electrons onto the anode.

U.S. Pat. No. 3,833,494 discloses a cathode for an electrical discharge tube that has a high electron emission and a long useful life. This cathode is composed of a rhenium carrier on which a lanthanum hexaboride layer is cataphoretically applied and is sintered thereon. A large formation of rhenium boride during the operation of the cathode can lead to the rupture of the rhenium carrier, and as a result, the useful life of the cathode is reduced.

A glow cathode for an electron tube having high emissivity is disclosed by U.S. Pat. No. 4,752,713. This glow cathode is composed of a heat-resistant, metallic or ceramic member serving as a carrier and of a metallic activation substance that promotes the electron emission and that is composed of an alloy of a group VIII metal as well as of rhenium and of an element from the group of Ba, Ca, La, Y, Gd, Ce, Th, U, or is replaced by an intermetallic compound of the same elements. This activation substance covers the entire surface of the carrier and can be a lanthanum and platinum alloy.

SUMMARY OF THE INVENTION

It is an object of the invention to provide an electron emitter for an x-ray tube which has an optimally high electron emission and a uniform distribution of the emitted electrons under all operating conditions, and that can be manufactured in a simple way.

This object is achieved by an electron emitter for an x-ray tube constructed in accordance with the principles of the present invention that forms a geometrical member which is completely filled with electron-emitting material, the side thereof facing toward the anode being excitable over its entire surface for emission of electrons, and wherein the electron-emitting material is composed of a mixture of conductive metal powder and a non-conductive powder or a ceramic material.

An advantage of the invention is that the electron emitter can be manufactured in a simple way as a compacted mixture having a uniform surface, and that a uniform electron emission occurs at emission temperature. When an inventively fashioned x-ray tube is driven into the saturation range, then all electrons are also extracted from the electron emitter, resulting in a uniform electron occupation on the anode. This uniform electron occupation also results in a uniform x-ray emission. If especially high x-ray tube currents are to be achieved, the material for emitting electrons preferably will contain La. In a preferred embodiment, the material for emitting electrons contains $LaB_6$ or a compound of La and Pt. This permits the conductivity of the emitting material to be set simply and within broad limits by the addition of non-conductive material, for example a ceramic powder, or by manufacturing a porous member. Members, moreover, can thus be manufactured that can be manipulated given the filament currents that are standard during the operation of the x-ray tube. The emitting material has a good electron emission and a high stability, resulting in a long service life of the cathode.

When a coating of $LaB_6$ or a compound of La and Pt is provided at least that side of the geometrical member facing toward the anode, this has a beneficial effect on the electron emission as well as on the service life of the electron emitter.

DESCRIPTION OF THE PREFERRED EMBODIMENTS

Figure 1:
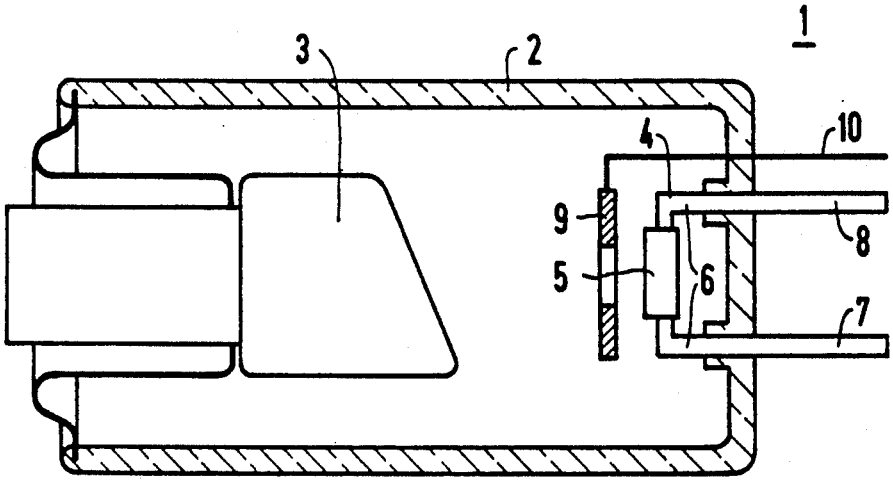
FIG. 1 is a side sectional schematic illustration of an x-ray tube having an electron emitter constructed in accordance with the principles of the present invention.

FIG. 1 shows an exemplary x-ray tube 1 having a glass member 2 in which an anode 3 and a cathode 4 are arranged. In this exemplary embodiment, the anode 3 is fashioned as a stationary anode, but the anode 3 could also be executed as a rotating anode. The cathode 4 has an emitter element 5 that is held by a mount 6. If the emitter element 5 is to be heated to emission temperature by direct current flow, a voltage is supplied to the emitter element 5 via terminals 7 and 8. To this end, these terminals 7 and 8 are conducted through a wall of the glass member 2. The emitter element 5, however, can also be heated by applying heat, i.e. indirectly. A grating 9 can be arranged between the anode 3 and the cathode 4 for controlling the electron emission, the terminal 10 of this grating 9 being likewise conducted to the exterior through the wall of the glass member 2. When the emitter element 5 is heated to emission temperature, it becomes surrounded by an electron cloud. By applying a voltage to the anode 3 that is positive in comparison to the cathode 4, the emitted electrons are accelerated in the direction of, and onto, the anode 3 where they convert their energy in the focal spot of the anode 3 into heat and x-radiation. By applying a voltage that is negative in comparison to the cathode 4 to the grating 9, the electron stream can be controlled, or suppressed as well. The grating 9 can also serve the purpose of focusing the electrons onto the focal spot of the anode 3.

Figure 2:
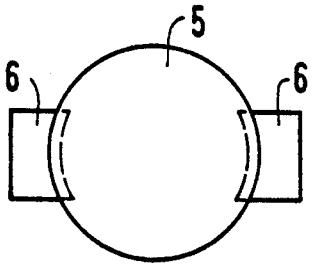
FIG. 2 is a plan view of a first embodiment of an electron emitter constructed in accordance with the principles of the present invention.

For a more detailed explanation of the inventive fashioning of the electron emitter, a first exemplary embodiment thereof is shown in plan view in FIG. 2. In this exemplary embodiment, elements that have a reference numeral in FIG. 1 are provided with the same reference numeral. The emitter element 5 is this exemplary embodiment is fashioned as a round disc and is held by the mount 6 in a press fit or clamp fit. A voltage can be supplied to the emitter element 5 via this mount 6, so that the emitter element 5 can be heated to emission temperature. In contrast to the prior art, this emitter element 5 forms a member that is completely composed of electron-emitting material. Differing from an electron emitter fashioned helically or serpentine, this emitter element 5 has a uniform surface that is completely formed by emission material. As already mentioned, this achieves an electron distribution, at least that side of the emitter element 5 facing toward the anode 3, which is uniform over the entire surface, so that the electrons accelerated onto the anode 3 also have a uniform electron distribution in the focal spot. The x-radiation generated in the focal spot is thus likewise uniform. Tungsten, a material containing La, preferably $LaB_6$, or a compound of at least one element from the group of rare earths and at least one element from the group of precious metals, thus, for example, $LaPt_x$, wherein x equals 1, 2 or 5, can preferably be employed as emission material for the emitter element 5.

It is known from the Journal of Applied Physics, Vol. 22, No. 3, March 1951, "Boride Cathodes" by J. M. Lafferty that $LaB_6$ has a high emission current density and a low evaporation rate. When $LaB_6$ is employed, for example, as emission material, then particular significance is to be given to the mounting of a polycrystalline sintered member manufactured with $LaB_6$ powder by pressure sintering or, hot-pressing. These sintered members are extremely hard and bittle and sensitive to tensile stresses. Moreover, they are difficult to solder and weld, and contact with metals leads to the destruction of the $LaB_6$ structure, so that the emission properties deteriorate over the course of time. These sintered members, however, can be advantageously held in clamp fits or press fits when they are in communication with graphite, carbon glass or with a ceramic material.

If a reduced conductivity of the electron-emitting material is desirable, then, for example, a compacted mixture can be manufactured that contains a mixture of $LaB_6$ or $LaPt_x$ and a non-conductive powder, for example a nitridic or oxidic, non-conductive, high-temperature-resistance ceramic powder, for example AlN, $Si_3N_4$ or $Al_2O_3$. Another way for reducing the conductivity is to manufacture the sintered member as a porous sintered member. The conductivity can thereby be set via the porosity. The conductivity of the emitter element 5 is preferably set such that the current that is absorbed by the electron emitter during the operation of the x-ray tube does not exceed a value of 50 amperes. In a preferred embodiment, this value lies in the range from 2 through 10 amperes.

A particular advantage of the use of porous material is that the electron-emitter material has a low vapor pressure and that the desired conductivity can be set.

The members manufactured in this way can be coated with a thin layer of $LaPt_x$ or $LaB_6$ for increasing the electron emission density.

The three-dimensional shape of the emitter element can be predetermined in the manufacturing procedure. It is thus possible to manufacture not only wafer-shaped sintered members but also, for example, to manufacture sintered members which are fashioned spherically or rod-shaped, or some other suitable three-dimensional form. The conductivity can be set on the basis of the selected three-dimensional shape of the sintered member.

Figure 3:
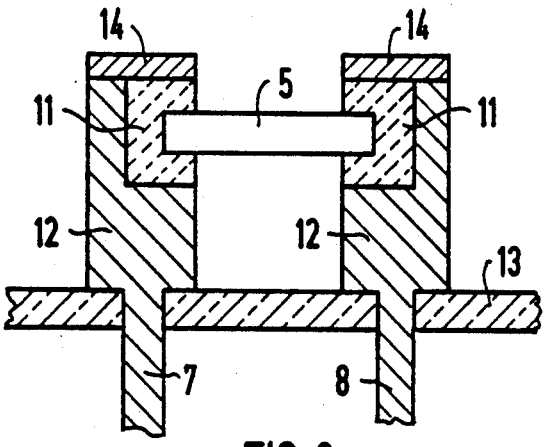
FIG. 3 is a side sectional view of a mount of an electron emitter constructed in accordance with the principles of the present invention.

FIG. 3 shows a side view of an example of a mount of an electron emitter. The emitter element 5, for example, is framed in its edge region by a contact material 11 of, for example, graphite, carbon glass or conductive ceramic such as, for example, carbides, borides, nitrides, sulfides or silicides. At least one supporting element (but preferably two supporting elements) 12 of, for example, nickel, molybdenum, titanium or Ni-Fe alloys that are in communication with a wall 13 of the glass member 2 are provided for further support. The terminals 7 and 8 are conducted through the wall 13 for supplying the emitter element 5 with voltage. A pressure plate 14 of nickel, molybdenum, titanium or Ni-Fe alloys can be provided at that end face of the supporting elements 12 lying opposite the terminals 7 and 8 for the purpose of fixing the emitter element 5. This figure thus shows an emitter element 5 that can be heated to emission temperature by direct current passage.

As previously mentioned, the emitter element 5 can also be heated to emission temperature by indirect application of heat. In, for example, an edge region, the emitter element 5 can be held by a single supporting element composed of a ceramic material. The application of heat can then ensue with a radiation source that, for example, is a thermal radiation source, electron source or a light source. According to FIG. 3 as well, however, the emitter element 5 can be held by two supporting elements of ceramic material, whereby a heating element is provided under the emitter element 5. The heating element can likewise be held by the supporting elements. For supplying voltage, terminals of the heater element can be conducted through the wall of the x-ray tube. The heat transmission to the emitter element 5 thereby ensues indirectly, i.e. by thermal radiation.

Figure 4:
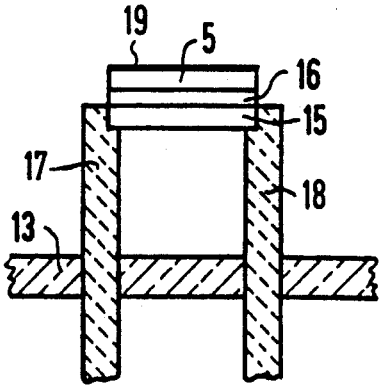
FIG. 4 is a side view of a further embodiment of an electron emitter constructed in accordance with the principles of the present invention, and a mount therefor.

A particularly advantageous structure of the electron emitter is shown in FIG. 4 wherein the emitter element 5 is fashioned as a planar layer and is in planar communication with a carrier layer 5 that is also planar. The potential for damage to the electron emitter given an impact on the x-ray tube is thus effectively minimized. If the emitter element 5 is heatable to emission temperature by direct current flow, the planar carrier layer 15 is preferably fashioned as an insulator.

If an electrically insulating but heat conducting layer 16, which is also planar, is provided between the planar layer of the emitter element 5 and the planar carrier layer 15 for electrical insulation of the emitter element 5, the carrier layer 15 can have a conductivity so that it acts as a heating element given the application of a voltage. The electron emitter can thus be indirectly heated to emission temperature by the carrier layer 15.

It is shown that the layers 5, 15 and 16 are held in common by two supporting elements 17 and 18 of metal or of a conductive ceramic that are in communication with the wall 13 of the x-ray tube 1. These supporting elements 17 and 18 can also serve the purpose of supplying voltage. This exemplary embodiment is thus an electron emitter in layer format. An electron emitter of the invention unites the advantages of an especially high service life, an especially good stability and a uniform emission.

In the exemplary embodiment of the electron emitter according to FIG. 4, a coating 19 of $LaB_6$ or a compound of lanthanum and platinum is provided at least that side of the geometrical member facing toward the anode. This has an especially beneficial effect on the electron emission as well as on the service life of the electron emitter 5.

Preferably the cathode 4, particularly the emitter element 5, is permanently held at emission temperature during the "stand-by" mode of the x-ray tube 1 or of the x-ray arrangement, i.e. during a time wherein no x-radiation is to be generated, which can be in the range from 5 minutes through 24 hours. Thermal stresses are avoided as a result thereof, which mechanically stress the emitter element 5. Residual gases are also prevented from being adsorbed by the emitter element 5 during the "stand by" mode, which would deteriorate the emission properties.

Although modifications and changes may be suggested by those skilled in the art, it is the intention of the inventor to embody within the patent warranted hereon all changes and modifications as reasonably and properly come within the scope of his contribution to the art.

I claim as my invention:

1. An electron emitter for an x-ray tube, said electron emitter comprising:

a geometrical member completely filled with electron-emitting material and having a side facing an anode excitable for the emission of electrons over its entire surface;

said electron-emitting material consisting of a mixture of conductive metal powder and a constituent selected from the group consisting of non-conductive powders and ceramic materials; and means for permanently maintaining said electron emitter at an emission temperature during a stand-by mode.

2. An electron emitter as claimed in claim 1, wherein said electron-emitting material consists of a mixture of $LaB_6$ and a ceramic powder for reducing the conductivity of said electron-emitting material.

3. An electron emitter as claimed in claim 1 wherein said electron-emitting material comprises a mixture of a compound of La and Pt and a ceramic powder for reducing the conductivity of said electron-emitting material.

4. An electron emitter as claimed in claim 1 wherein said electron-emitting material is porous for reducing the conductivity of said electron-emitting material.

5. An electron emitter as claimed in claim 1 wherein said ceramic material consists of ceramic material selected from the group consisting of AlN, $Si_3N_4$ and $Al_2O_3$.

6. An electron emitter as claimed in claim 1 further comprising a mount for said electron emitter, said mount having regions in contact with said electron emitter and at least those regions of said mount consisting of material in the group consisting of graphite, carbon glass and ceramic materials.

7. An electron emitter as claimed in claim 1 wherein said electron-emitting material is formed as a layer, and further comprising a carrier layer in planar contact with said layer of electron-emitting material.

8. An electron emitter as claimed in claim 7, further comprising an electrically insulating and heat conducting layer disposed between said layer of electron-emitting material and said carrier layer.

9. An electron emitter as claimed in claim 1 further comprising a coating on said side of geometrical member facing toward said anode, said coating consisting of material from the group consisting of $LaB_6$ and compounds of La and Pt.

* * * * *